US007578077B2

(12) United States Patent
Marc

(10) Patent No.: US 7,578,077 B2
(45) Date of Patent: Aug. 25, 2009

(54) SHOE SOLE CONSTRUCTION

(76) Inventor: Michel Marc, 7926 Ryckert St., Lenexa, KS (US) 66219

( * ) Notice: Subject to any disclaimer, the term of this patent is extended or adjusted under 35 U.S.C. 154(b) by 421 days.

(21) Appl. No.: 11/640,631

(22) Filed: Dec. 18, 2006

(65) Prior Publication Data

US 2008/0141559 A1 Jun. 19, 2008

(51) Int. Cl.
*A43B 13/20* (2006.01)
*A43B 13/18* (2006.01)

(52) U.S. Cl. ..... 36/103; 36/27; 36/29

(58) Field of Classification Search ..... 36/103, 36/27, 29, 105, 132, 25 R, 35 B, 7.8
See application file for complete search history.

(56) References Cited

U.S. PATENT DOCUMENTS 4,312,140 A * 1/1982 Reber ..... 36/3 B
4,435,910 A 3/1984 Marc
4,441,876 A 4/1984 Marc
4,858,338 A * 8/1989 Schmid ..... 36/102
5,068,983 A 12/1991 Marc
5,146,698 A 9/1992 Tilles et al.
5,706,589 A * 1/1998 Marc ..... 36/27
5,839,210 A * 11/1998 Bernier et al. ..... 36/50.1
5,918,502 A * 7/1999 Bishop ..... 36/136
6,928,756 B1 * 8/2005 Haynes ..... 36/27
2006/0021261 A1 * 2/2006 Face ..... 36/132

* cited by examiner

*Primary Examiner*—Ted Kavanaugh
(74) *Attorney, Agent, or Firm*—David M. Driscoll, Esq.

(57) ABSTRACT

A shoe sole construction adapted to absorb and store impact energy and including a shoe sole that has a heel portion and a forefoot portion. The forefoot portion includes the toe of the sole. The shoe sole includes a base member and at least one pressure plate for receiving a wearer's foot. A first pivot is disposed between the base member and the pressure plate. The first pivot is disposed at the toe of the sole. A bladder is provided to receive and store impact energy delivered thereto, and is disposed at the heel portion of the shoe sole and positioned to be compressed under the impact energy imposed thereupon by the pressure plate. A locking mechanism is disposed at the forefoot portion, between the base member and pressure plate. The locking mechanism is responsive to a compression of the bladder and released during the propulsive phase of the wearer's gait to return stored energy for release during the propulsive phase.

22 Claims, 10 Drawing Sheets

SHOE SOLE CONSTRUCTION

BACKGROUND OF THE INVENTION

The present invention relates generally to footwear and is more particularly related to a shoe sole construction wherein the impact energy of the heel strike is absorbed, stored, delayed and then the stored energy is beneficially returned at the right time to aid in the propulsion of the wearer during the propulsive phase of the human gait.

In human locomotion the walking gait cycle is generally considered as comprising two distinct phases: (a) the stance phase, and (b) the swing phase. The beginning of the stance phase is signaled by the strike of the foot against the support surface. At this point of the cycle the foot begins to become loaded with body weight and, in response, pronates, thereby to result in a lowering of the medial longitudinal arch, an outward turning of the foot and an inward rotation of the leg. During this pronation of the foot the bony articulations or joints of the mid and hind foot loosen somewhat in order that the foot can both adjust to the support surface and absorb the mechanical shock of strike and weight bearing. If the strike is at the heel, as compared to the ball or flat-footed, as the plantar surface of the foot rolls forward onto the support surface, at some point subsequent to midstance, the heel begins to invert and the foot begins to resupinate. At this juncture of the stance phase the forefoot is fixed to the support surface, the heads of the first and fifth metatarsals are splayed apart and the foot is in a rigid structural condition and, ideally, in a neutral, that is to say, neither a pronated nor a supinated position. Next, plantar-flexion of the foot begins, the arch becomes rigid and the heel lifts off the support surface, usually with accompanying further supination. The plantar fascia shortens and the toes begin to flex, creating a so-called "windlass effect" whereby the arch is elevated. This constitutes the final or "propulsive" segment of the stance phase immediately preceding the beginning of the swing phase of the gait cycle and the strike of the opposite foot. In the normal swing phase, during which the foot is lifted entirely off the support surface and, therefore, is in a non-weight bearing condition, the ideal foot returns from its supinated position to a neutral position, as do the articulations of the fore, mid and hind foot, all in preparation for the onset of the foot's next stance or weight bearing phase.

Unlike walking, wherein at least a portion of the gait cycle involves double-limb support of the body and a sharing of the body weight therebetween, the running gait cycle includes a third or "float" phase interposed between the stance and swing phases and during which "float" phase both feet are off the ground and following which only one foot receives the entirety of the ground impact forces. The stance or weight bearing phase is substantially shorter than in walking. Thus, in running, the ground contact impact forces imposed upon the anatomy of the foot are substantially greater, usually about three times greater, and require the foot, leg, hip and spinal anatomy to accommodate these stresses over a substantially shorter period of time than in walking. These factors particularly associated with the running gait thus pose an ever present orthopedic threat to the well being of the runner's anatomy of locomotion and have spawned the development of various energy absorptive devices for use in footwear. In general, the known protective devices for runners and athletes take the form of various compressible viscoelastic pads and pillows installed as insole elements under the heel or entire foot of the wearer and which serve to absorb at least a substantial portion of the impact energy of the strike. Usually, these devices act by compression under the loads imposed by the strike and by conversion of this mechanical energy into heat. While effective to various degrees in providing physical protection to the anatomy of locomotion, particularly to that of the foot, the heat generated within these devices can contribute to an uncomfortably warm environment within the wearer's shoe. Moreover, the impact energy absorbed by these devices is simply dissipated and is not returned in any beneficial way to the wearer.

Reference is also made to my earlier U.S. Pat. No. 5,706,589 for a description of one shoe sole construction in which, during the stance phase of the wearer's gait cycle, the impact energy of a heel strike is absorbed, stored and, at least in part, returned to the underside of the forefoot during the propulsive phase of the gait, thereby aiding in the locomotion of the wearer. With this construction, following the propulsive phase of the gait cycle, the sole construction is restored to a condition suitable for absorption and storage of the impact energy of the next heel strike event thereupon. Although this construction represented some improvement in performance, it still did not provide universal application for all styles of running and/or walking.

OBJECTS OF THE INVENTION

Accordingly, it is an object of the present invention to provide a novel shoe sole construction adapted to absorb and return at least a portion of the impact energy of the strike of the wearer, regardless of the running or walking mode of the wearer, including, but not limited to, a heel strike, impact at the ball of the foot or a flat-footed contact.

It is another object of the present invention to provide a shoe sole construction wherein the impact energy of the strike of the wearer is absorbed, delayed and returned to the sole at the right time of the gait.

It is still another object of the present invention to provide a novel shoe sole construction wherein substantially all of the impact energy of the strike is absorbed, stored and then reconverted into mechanical energy under the forefoot to aid in the propulsion of the wearer.

A further object of the present invention is to provide a shoe sole construction wherein the impact energy of the strike of the wearer is absorbed, delayed and returned to the sole at the right time of the gait and with little or no net generation of heat within the shoe.

Other objects and advantages of the present invention are set forth in more detail hereinafter.

SUMMARY OF THE INVENTION

To accomplish the foregoing and other objects, features and advantages of the present invention there is provided a shoe sole construction adapted to absorb and store impact energy received from the action of a wearer's gait and to deliver said stored energy into the propulsive phase of the gait. The shoe sole construction comprises:

a shoe sole element of resilient rubbery construction and having heel and forefoot portions, said forefoot portion including the toe of the sole;

the shoe sole element including a base housing and at least one pressure plate for receiving the wearer's foot;

at least a first pivot between said base housing and said pressure plate;

energy storage means to receive and store impact energy delivered thereto, said energy storage means disposed at said heel portion of said shoe sole element and positioned to be compressed under the impact energy imposed thereupon by said pressure plate;

and a locking means disposed at the forefoot portion, between said base housing and pressure plate and having respective locked and released positions;

the locking means assuming said locked position in response to a compression of said energy storage means;

the locking means moving to said released position during the propulsive phase of the wearer's gait to return stored energy for release during the propulsive phase.

Additional aspects of the present invention include said at least one pressure plate including a rigid heel pressure plate and a rigid forefoot pressure plate, both of which overlie said base housing; a portion of said heel pressure plate extends over a rearwardly extending portion of said forefoot pressure plate; including a second pivot between said forefoot pressure plate and said heel pressure plate; said second pivot comprises a pair of spaced pivots disposed respectively on opposite sides of said shoe sole element; including a second pivot between said forefoot portion and said heel portion and disposed at a location corresponding to the joint between the planter fasciae bone and the phalange; said base housing includes a heel section and a forefoot section and said energy storage means comprises a pneumatic bladder disposed in a recess between said heel section and pressure plate; said bladder has a pressure adjustment means that is set based on the weight of the wearer; said first pivot is disposed at the toe of the wearer so that the locking means responds to a strike whether at the heel or forefoot portions or therebetween; said locking means comprises a locking mechanism that includes a linkage attached to said pressure plate, a frame and a carriage moveable in the frame and for supporting said linkage; said locking means comprises a locking mechanism having a transfer linkage and a release lanyard that is secured to said linkage at one end and to said shoe sole element at an opposite end; said lanyard has an adjustment means so that the angle of release of the locking mechanism is adjustable; said locking mechanism also includes a frame for receiving a movable carriage, a spring for biasing the position of said carriage and a linkage arm, said linkage arm and transfer linkage being in an over-center position when the locking mechanism is in its locked position; said carriage has an angled slot and further including a first pin in slots in said frame and said angled slot and a second pin that interconnects said transfer linkage and linkage arm; and said locking means operates to temporarily maintain said pressure plate in a downward condition between the end of the strike event and the onset of the propulsive phase of the wearer's gait.

In accordance with another feature of the present invention there is provided a shoe sole construction adapted to absorb and store impact energy and comprising: a shoe sole that includes a heel portion and a forefoot portion; said forefoot portion including the toe of the sole; said shoe sole including a base member and at least one pressure plate for receiving a wearer's foot; a first pivot between said base member and said pressure plate; said first pivot disposed at the toe of the sole; an energy storage member to receive and store impact energy delivered thereto; said energy storage member disposed at said heel portion of said shoe sole and positioned to be compressed under the impact energy imposed thereupon by said pressure plate; and a locking mechanism disposed at the forefoot portion, between said base member and pressure plate; said locking mechanism responsive to a compression of said energy storage means and released during the propulsive phase of the wearer's gait to return stored energy for release during the propulsive phase.

Further aspects of the present invention include said at least one pressure plate includes a rigid heel pressure plate and a rigid forefoot pressure plate, both of which overlie said base member; including a second pivot between said forefoot pressure plate and said heel pressure plate; said base member comprises a base housing includes a heel section and a forefoot section and said energy storage member comprises a pneumatic bladder disposed in a recess between said heel section and pressure plate; said locking mechanism includes a linkage attached to said pressure plate, a frame and a carriage moveable in the frame and for supporting said linkage; said locking mechanism has a transfer linkage and a release lanyard that is secured to said linkage at one end and to said shoe sole at an opposite end; and said locking mechanism also includes a frame for receiving the movable carriage, a spring for biasing the position of said carriage and a linkage arm, said linkage arm and transfer linkage being in an over-center position when the locking mechanism is in its locked position.

BRIEF DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION

General Discussion

The principle of the present invention relate to the ability of the shoe sole to, not only absorb and store the impact energy (potential energy of a runner or weight of a walker), but to also timely delay and release the stored energy. This concept provides for a return of the absorbed energy at the proper time when the foot bends during propulsion and at the correct place which is preferably under the ball of the foot. This action is performed by means of an automatically releasable locking means or mechanism that is described in more detail hereinafter. Refer to FIGS. 1-15 for details of a preferred embodiment of a shoe sole construction in accordance with the principles of the present invention. FIGS. 16-20 provide additional details in the form of graphs and schematic representations for further explanations of the concepts and theory of the principles of the present invention.

General Concepts of the Invention

Figure 16:
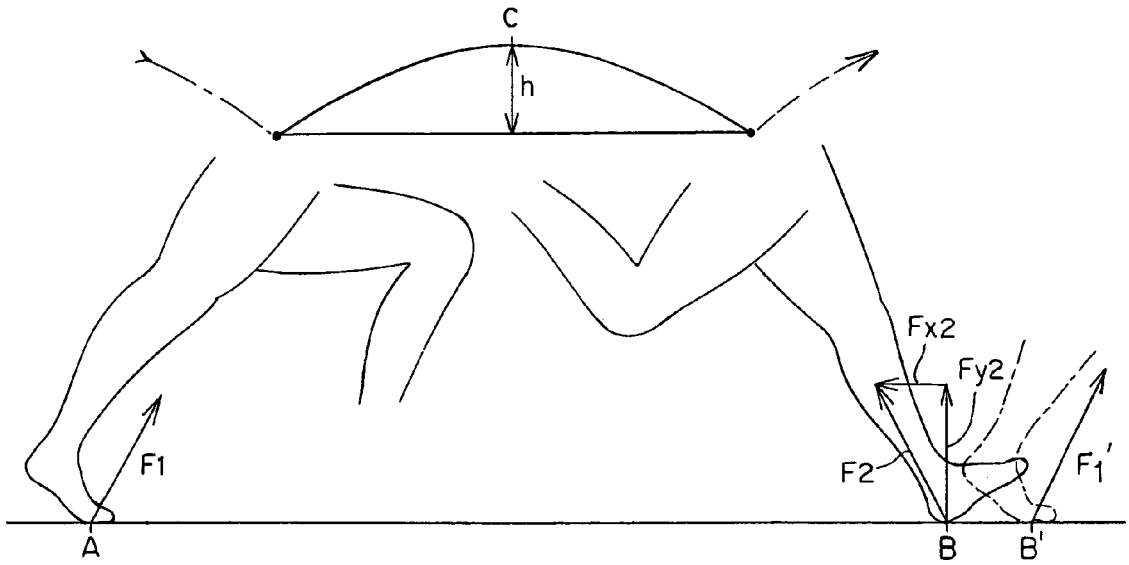
FIG. 16 is a schematic representation showing the typical forces associated with the motions of a runner.

Reference is now made to FIG. 16 for an illustration of the forces that are generated during the stride. In these discussions reference is made to the "heel" strike in explaining the concepts of the present invention, however, it is understood that the principles of the present invention apply also to other forms of strikes to the foot such as by impact at other areas of the foot such as at the ball of the foot or at the arch of the foot.

During the propulsion phase, a runner pushes on one foot (force $F_1$ at point A) and propels himself or herself off the ground. For a period of time no foot is on the ground, which defines the running gait. The body reaches the peak of its motion at point C, where it falls off the height h on the other foot and where the impact is then received at the heel, represented in FIG. 16 by Force $F_2$ at point B.

The potential energy E=M×g×h mass×gravity×height can either be absorbed and/or returned.

A1. If the energy is absorbed:

1. The energy is lost and is not used by the runner to propel himself or herself back up at the next step.
2. This absorbed energy is transformed into heat which is a major cause for temperature built-up in the shoe, which in turn through the glands creates sweat.

Figure 20:
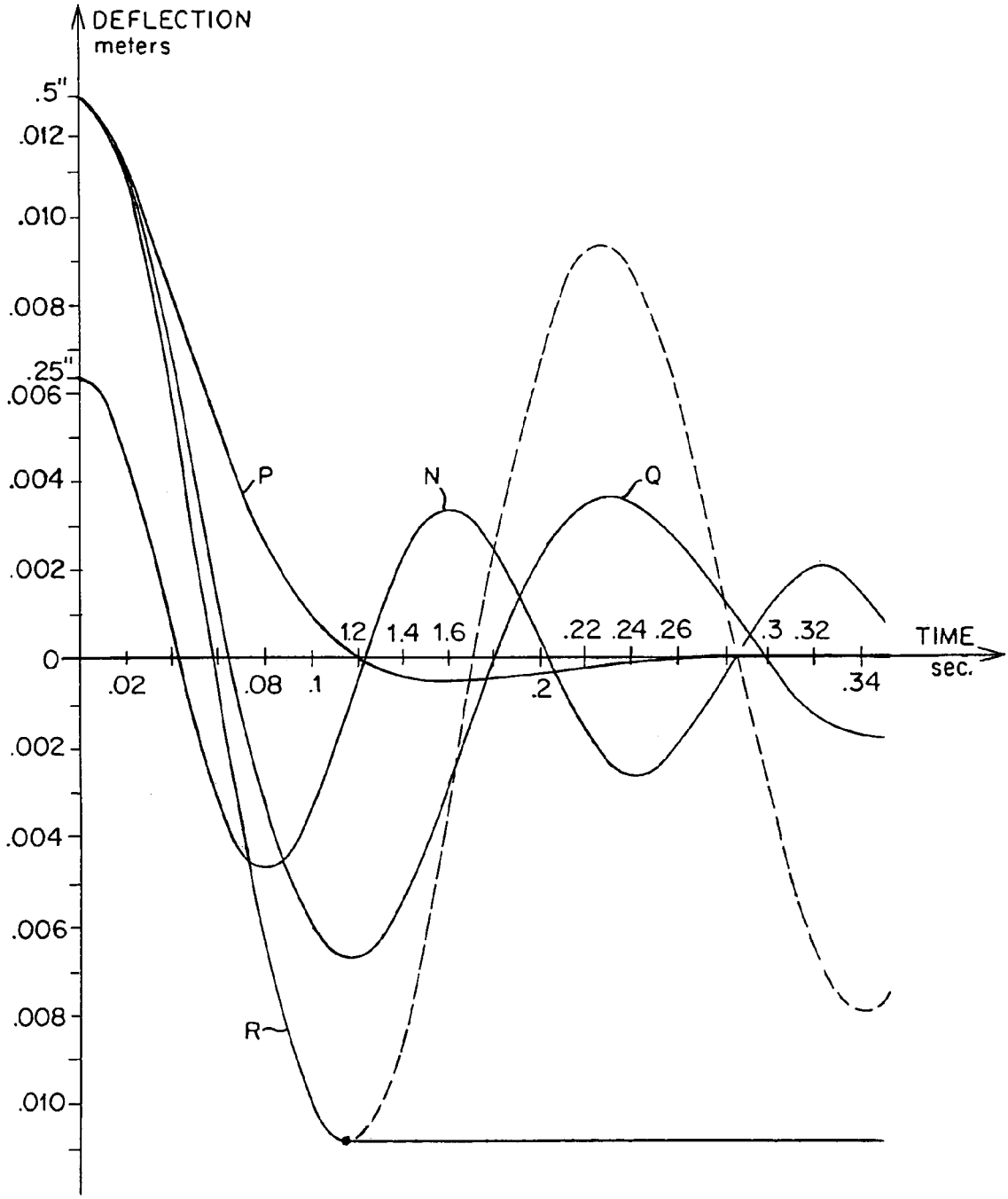
FIG. 20 is a series of graphs for illustrating the concepts of the present invention helpful in explaining the performance of the shoe sole.

B1. If the energy is returned:

1. It slows the runner down. When the energy is returned at the heel the foot is forward and the force F2 has a horizontal component $F_{x2}$ that pushes the runner back.
2. In addition, there is a feed back, oscillations and vibrations that are created which hurt joints, the spine, etc. Refer to FIG. 20 for an illustration of these oscillations.

Both of the above options are undesirable.

Now, in accordance with the present concepts a "time" parameter is taken into consideration. In this regard it is important to consider the distinction between point B and point B' in FIG. 16.

The principle is:

1. To absorb all the energy created by the force F2 maximum at the heel strike (or other strike such as at the arch or ball).
2. To store that energy using a locking device and allow a time delay that corresponds to the time difference in going from point B to point B'.
3. To return that energy a) where needed—at the ball of the foot at point B' b) when needed—during the propulsion phase. This returned energy is released anatomically at a proper foot position.

The major advantages of this concept are:

I. To be more efficient by allowing the wearer to run faster and/or for a longer period of time.

II. To be better for the body;

1. By optimizing cushioning, reducing the shock at the heel strike and having a progressive force back during a greater heel compression with a smaller constant deceleration.
2. By eliminating the rebounds—the feed back presently occurring at the heel strike produces oscillations which hurt joints and the spine.

III. And to be more comfortable—by not producing heat during the full cycle, consequently reducing sweat as well. When the energy is returned by expanding the gas, cold is created to offset the heat generated during energy absorption when the gas is compressed.

Figure 17:
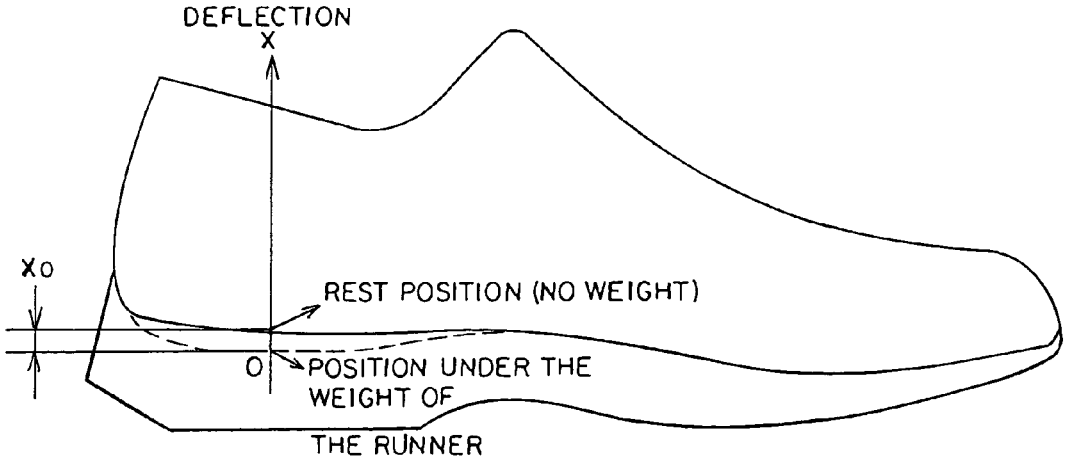
FIG. 17 is a schematic diagram illustrating deflection.
Figure 18:
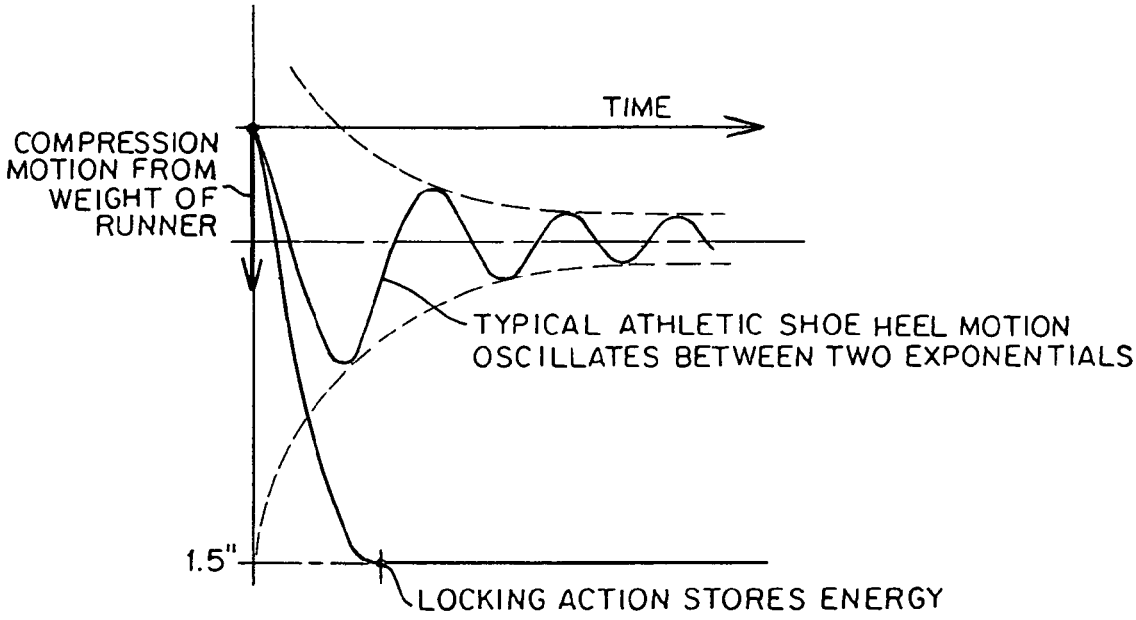
FIG. 18 is a graph associated with the concepts of the present invention.

Reference is again made to diagrams shown in FIGS. 16-20 for further explanations of the principles of the present invention. Thereafter, a detailed embodiment of the invention is illustrated in FIGS. 1-15. Refer now to FIGS. 16, 17 and 20, as they relate to the following explanation.

In running, during the heel strike three forces are involved:

a) The force created by the mass M of the runner;

$$F = M\frac{d^2x}{dt^2}$$

proportional to the acceleration;

b) The force created by the shock absorption effect;

$$F = c\frac{dx}{dt}$$

proportional to the speed;

c) The force created by the spring effect;

F=kχ proportional to the displacement

In FIG. 17, the deflection x at the heel during impact is a function of time (k times χ) and is dictated by the following differential equation of the second order:

$$M\frac{d^2\chi}{dt^2} + c\frac{d\chi}{dt} + k\chi = 0$$

Which solution is:

$$\chi_{(t)} = e^{-\varepsilon\omega_n t}\left[\chi_0\cos\omega_d t + \left(\frac{\chi'o + \varepsilon\omega_n\chi_o}{\omega_d}\right)'\sin\omega_d t\right] \quad \text{equation 1}$$

with $\chi_0$=initial displacement, $\chi'_0$=initial velocity in our case=0ω, $$n = \sqrt{\frac{k}{M}}$$

where M=mass equation 2 and $\omega_d=\omega_n\sqrt{1-\epsilon^2}$ equation 3 at equilibrium $kx_0=Mg$ (g=gravity g=9.81 m/S$^2$ meter/second$^2$) equation 4

Let's assume the weight of the runner is 160 lb=72.64 kg.

The following are some examples or cases:

Case 1. In a traditional shoe, a typical case would be $\chi_0$=¼ inch=0.00635 m and $\epsilon$=0.1 then $$k = \frac{Mg}{\chi o} = \frac{72.64\times 9.81}{.00635} = 112{,}220$$

from equation 4

Since $\chi'_0$ =equation 1 is now:

$$\chi_{(t)}e_n^{-\varepsilon\omega t}[\cos\varpi_d t] + \frac{\varepsilon\varpi_n}{\varpi_d}\sin\varpi_d t$$

with $$\omega_n = \sqrt{\frac{k}{M}} = 39.3$$

from equation 2

$$\omega_d=\omega_n\sqrt{1-\epsilon^2}=39.1$$

from equation 3

$$\frac{\varepsilon\omega_n}{\omega_d} = .1005$$

equation 1 is $\chi_{(t)}=e^{-3.93t}x0.00635[\cos 39.1t+0.1005 \sin 39.1t]$ ($\chi_{(t)}$=displacement function of time, t=time)

This solution is represented in FIG. 20 by the curve N. One can observe the oscillations and feedbacks in FIG. 20.

To give a smoother motion and a better cushioning one can choose a softer midsole which provides a greater deflection $\chi_0$=½ inch=0.0127 m which will be used for case 2, 3 and 4, where we will vary the shock absorption effect.

$$\omega_n = \sqrt{\frac{g}{\chi o}} = 27.8$$

from equation 4

$$K\chi_0 = Mg \text{ or } \frac{k}{m} = \frac{g}{\chi_0}$$

so from equation 3

$$\omega_n = \sqrt{\frac{k}{M}} \text{ also } \sqrt{\frac{g}{\chi o}} = \sqrt{\frac{9.81}{.0127}} = 27.8 = \omega_n$$

Case 2. We could choose for ideal cushioning, a strong shock absorber with $$\varepsilon = \frac{1}{\sqrt{2}} = .7071$$

then from equation 2 $\omega_d=\omega_n\sqrt{1-\epsilon^2}=\omega_n\sqrt{1-(0.707)^2}=0.707\ \omega_n$ so $\omega_d=\epsilon\omega_n=0.707\times 27.8=19.657$ $$\chi_{(t)}=e^{-19.657t\times 0.0127}(\cos 19.657t+\sin 19.657t)$$

This solution is represented in FIG. 20 by the curve P. It is an ideal cushioning, with no or very little feedback and vibrations but a lot of energy has been absorbed.

Case 3. To absorb less energy let's take $\epsilon$=0.2

$\chi_0$ did not change so $$\omega_n = \sqrt{\frac{g}{\chi_0}} = 27.8$$

$$\varepsilon\omega_n = 5.56$$

$$\omega_d = \omega_n\sqrt{1-\varepsilon^2} = 27.238$$

$$\frac{\varepsilon\varpi_n}{\varpi_d} = \frac{.2\times 27.8}{27.238} = .2041$$

so equation 1 becomes $x_{(t)}=e^{-5.56t\times 0.0127}$ (cos 27.238t+0.2041 sin 27.238t)

This solution is represented in FIG. 20 by the curve Q. It also has oscillations similar to the curve N of case 1.

Case 4. We choose no or very little shock.0 absorption $\epsilon$=0.05

$\epsilon\omega_n=0.05\times 27.8=1.39\ \omega_d=\omega_n\sqrt{1-(0.05)^2}=27.765$ $$\frac{\varepsilon\varpi_n}{\varpi_d} = \frac{.05\times 27.8}{27.765} = .05$$

which gives equation 1 $\chi_{(t)}=e^{-1.39t\times 0.0127}$ (cos 27.765t+0.05 sin 27.765t)

This solution is represented in FIG. 20 by the curve R in our shoe. This is the solution where at point A on the curve R a locking mechanism (described later) stops the motion and creates the solid line instead of the dotted oscillating curve. There is no feed back nor are there oscillations. This solution allows the full impact, maximum energy to be stored and optimizes cushioning by having the greatest deflection possible, smoother motion and smaller deceleration.

Figure 19:
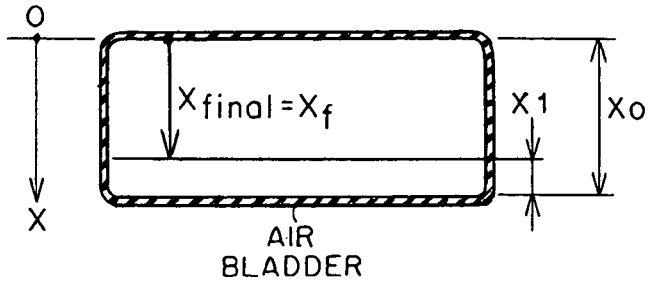
FIG. 19 is a schematic diagram illustrating the bladder and associated deflection.

The storage of energy in the disclosed embodiment is accomplished with the use of an air bladder. The air bladder is preferred in that it can return the energy at once which is needed in the propulsion phase for optimum efficiency. Refer to FIG. 19 that illustrates schematically the bladder 8 and associated deflections and also to FIG. 16.

For a calculation of the energy stored, the air pressure in the bladder and the initial force that is returned, reference is now made to the following analysis.

E=energy given by the runner which is potential energy, since at one time there are no feet on the ground.

$$E=m\times g\times h \qquad \text{equation 5}$$

m=mass of the runner g=gravity h=distance of vertical motion of the center of gravity of the runner (see concept on athletic shoe in FIG. 16).

That energy, if no losses, is received by the bladder. Refer to the bladder diagram in FIG. 19.

P=air pressure in the bladder

V=volume of air in the bladder x=deformation, compression of the bladder

S=area of the bladder.

At rest bladder thickness is $x_0$, no force applied, $P_o$ and $V_o$=pressure and volume at rest, no force applied $x_1$=thickness of bladder after the energy E has been applied.

$P_1$ and $V_1$=pressure and volume after the energy has been applied.

The area of the bladder S remains the same, $x_f=x_{final}$ after the energy has been applied.

One considers the air temperature constant in the bladder (as the air heats when compressed but it also cools when it expands).

$$\text{Then } P_{(\chi)}V_{(\chi)}=\text{constant}=P_0V_0=P_1V_1 \qquad \text{equation 6}$$

$$V_0=S_{\chi 0}V_1=S_{\chi 1}V_{(\chi)}=S_{(\chi 0-\chi)} \qquad \text{equation 7}$$

$V_{(\chi)}$ volume $P_{(\chi)}$ pressure $F_{(\chi)}$ force applied are function of the deformation $\chi$.

$$\text{The force received } F_{(\chi)}=P_{(\chi)}\times S \qquad \text{equation 8}$$

$$\text{the energy received: } dE_{(\chi)}=F_{(\chi)}\times d_{(\chi)} \qquad \text{equation 9}$$

is the force times the displacement.

$P_{(\chi)}V_{(\chi)}=P_0V_0$ gives $$P_{(\chi)}=\frac{PoVo}{V(\chi)}=\frac{S\chi_o Po}{S(\chi_o-\chi)}=\frac{P_o\chi_o}{\chi_o-\chi} \qquad \text{equation 10}$$

$P_{(\chi)}$ put in equation 8 gives $$F(\chi)=P(\chi)S=\frac{PoS\chi_o}{\chi_o-\chi}$$

Equation 9 becomes $$dE_{(\chi)}=F_{(\chi)}d\chi=P_{(\chi)}Sd\chi=\frac{Po\chi_o Sd\chi}{\chi_o-\chi}$$

By integrating for displacement $\chi$ varying between 0 and $\chi_f$ $$E=\int_0^{\chi_f}\frac{Po\chi_o Sd\chi}{\chi_o-\chi}=P_o\chi_o S\int_o^{\chi_f}\frac{d\chi}{\chi_o-\chi}$$

as Po, $\chi$o and S are constant.

gives $E=Po\chi oS[-l_n(\chi_o-\chi)]_o^{\chi_f}$ $l_n$=logarithm neperian $$\int_0^{\chi_f}\frac{d\chi}{\chi_o-\chi}=[-\ln(\chi_0-\chi)]_0^{\chi_f}$$

gives $E=Po\chi oS[-l_n(\chi_o-\chi_f)+l_n(\chi_o-o)]$ $E=Po\chi oS[l_n\chi_o-l_n(\chi_o-\chi_f)]$ which is equal to energy received.

Equation 5 E=mgh $$\text{Conclusion mgh}=P_o\chi_o S[l_n\chi_o-l_n(\chi_o-\chi_f)] \qquad \text{equation 11}$$

As the energy received is the same as the one applied.

Let's calculate the initial propulsive force pushing the runner to the next step which is the pressure in he bladder at the end of the deformation: $P_1$ times the area S $F=P_1S$ from equation 6

$$P_1=\frac{PoVo}{V_1}=\frac{PoS\chi o}{S\chi_1}=\frac{Po\chi o}{\chi_1}\text{ so }F=\frac{Po\chi oS}{\chi_1}$$

and equation 11 gives $$Po\chi oS=\frac{mgh}{l_n\chi_o-l_n(\chi_o-\chi_f)} \qquad \text{equation 12}$$

therefore $$F=\frac{mgh}{\chi_1[l_n\chi_o-l_n(\chi_o-\chi_f)]}$$

$$\begin{aligned}F&=P_1S\\&=\frac{Po\chi o}{\chi_1}S\\&=\frac{Po\chi oS}{\chi_o-\chi_f}-l_n(\chi_o-\chi_f)\\&=\frac{mgh}{Po\chi oS}-l_n\chi_o\end{aligned}$$

Let's take an example−a runner of mass−m−70 Kg (kilograms)=154 lbs h=2 inches=0.0508 meter g=9.81 m/sec$^2$ E=mgh=70×0.0508×9.81=34.88 Joules $P_0$ absolute=Pressure (no pressure in bladder)=0+atmospheric pressure=?

$P_0$=101,325 Pascals=14.7 PSI (pounds per square inch)

S=2.5 in×3.5 in.=8.75 inch$^2$=0.00564 m$^2$ (meter square)

$x_0$=1.5 in=0.0381 m
equation 11 gives $$l_n\chi_0 - l_n(\chi_0 - \chi_f) = \frac{mgh}{Po\chi oS}$$

$$l_n\chi_0 - l_n(\chi_0 - \chi_f) = \frac{34.88}{101325 \times .00564 \times .0381} = 1.6$$

$l_n\chi_0$=ln(0.0381)=−3.2675
−ln (xo−xf)=1.6+3.2675=4.8675
ln(xo−xf)=−4.867 which means $e^{-4.8675}=\chi_0-\chi_f$ which is $\chi_1$ thus $\chi_1=e^{-4.8675}$
y logarithm neperian
conclusion $\chi_1$=0.00769 meter=0.303 inch
equation 6 gives $$P_1 = \frac{PoVo}{V_1} = \frac{PoS\chi o}{S\chi_1} = P_o\frac{\chi_0}{\chi_1}$$

$$P_1\text{absolute} = \frac{Po_{\text{abs}} \times x_o}{x_1} = \frac{14.7 \times 1.5}{.303} = 72.8\ PSI$$

$P_1$real=$P_1$abs−Patm=72.8−14.7=58.1 PSI
so the initial force pushing the runner up when the locking mechanism unlocks is $$F=P_1 \times S=58.1 \times 8.75=508\text{lbs}$$

F=508 lbs which is over 3 times the runner's weight with $x_1$=0.303 inch and $x_f=x_0-x_1$=1.197 inch. Let's find the deformation of the bladder and pressure in the bladder which is under the weight of the wearer (walking) if h=0 the pressure in the bladder is $$\frac{154^{\text{lbs}}}{\text{area } 8.75 \text{ inch}^2} = 17.6\ PSI$$

(pounds per square inch) and atmospheric P=14.7 PSI
Absolute pressure is 17.6+14.7=32.3 PSI=$P_W$
Equation 6 $P_0V_0=P_wV_w$ $V_w$=volume of bladder and $\alpha_\omega$=height of bladder under the weight of the wearer $$V\varpi = \frac{PoVo}{P\varpi} = \frac{PoS\chi_o}{P\varpi} = S\ \chi\varpi \text{consequently}$$

$$\chi\varpi = \frac{Po\chi_o}{P\varpi}$$

$\chi_o$=1.5 inch $$\chi_\varpi = \frac{14.7 \times 1.5}{32.3} = .683 \text{ inch}$$

thickness of bladder under weight $\chi_0-\chi_\omega$=0.817 inch deformation under weight of wearer One can thus conclude that the locking mechanism locks after a compression of the bladder of 0.8 inch to return the energy when the runner is walking (even gently) and after that still stays locked and maintains the lowest position the bladder has been compressed to; to thus absorb and then thereafter return the maximum energy.

Figure 1:
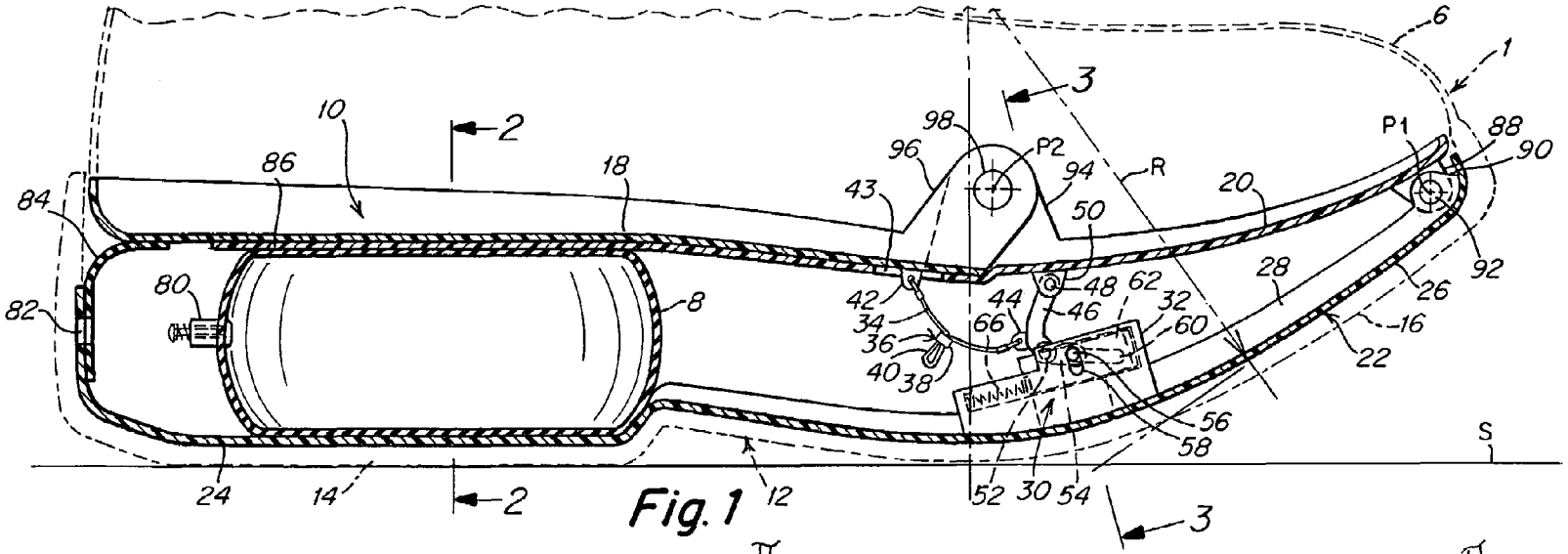
FIG. 1 is a somewhat schematic, cross sectional view of a shoe with an energy managing shoe sole construction in accordance with the invention.

Details of Disclosed Embodiment tempThe running shoe 1 is shown in FIG. 1 in a cross-sectional view with the shoe in an "at rest" position. The shoe is shown as including an upper 6 shown in phantom lines for simplicity. The shoe sole construction 10 also includes a rubber shoe sole element 12, shown in phantom lines, formed on its outer surface. The shoe sole 12 has a heel portion 14 and a forefoot portion 16 that may have any number of lug patterns (not shown) to provide cushioning and traction between the shoe 1 and a ground surface S. The shoe sole construction 10 also includes an air bladder 8 and a locking mechanism 30. The air bladder 8 is disposed at a rear portion while the locking mechanism 30 is disposed at a forward portion corresponding substantially to the ball of the foot.

It should be noted that for purposes of the present invention the term "forefoot" is intended to denote that portion of the foot which is maximally responsible for propulsive contact of the foot with the support surface and may be broadly anatomically defined as that portion of the foot existing between the distal ends of the metatarsals and the distal ends of the phalanges.

Figure 2:
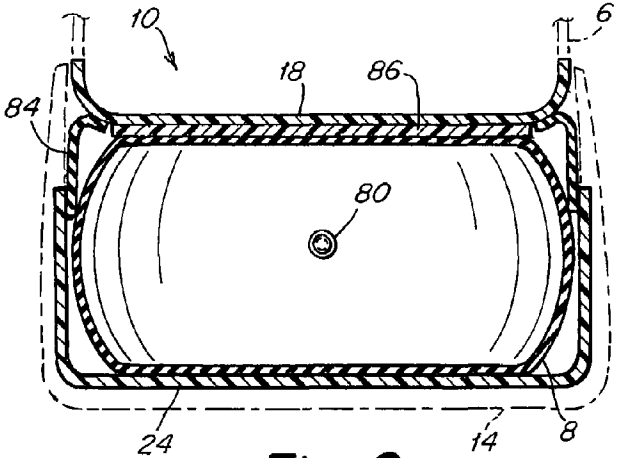
FIG. 2 is a transverse cross-sectional view taken along line 2-2 of FIG. 1.

The air bladder 8 and locking mechanism 30 are basically arranged sandwiched between the layers that form the main enclosing structure of the shoe sole construction 10. This includes the relatively rigid pressure plates 18 and 20 and the relatively-rigid housing 22 that has the rubber shoe sole element 12, shown in phantom line, formed on its outer surface. Many different forms of the shoe sole element 12 may be used. For stability purposes, the air bladder 8 is attached, such as by adhesive means at its upper and lower surfaces to the pressure plate portion 86 and heel portion 24 of the housing 22, respectively, and as shown in FIGS. 1 and 2.

Figure 3:
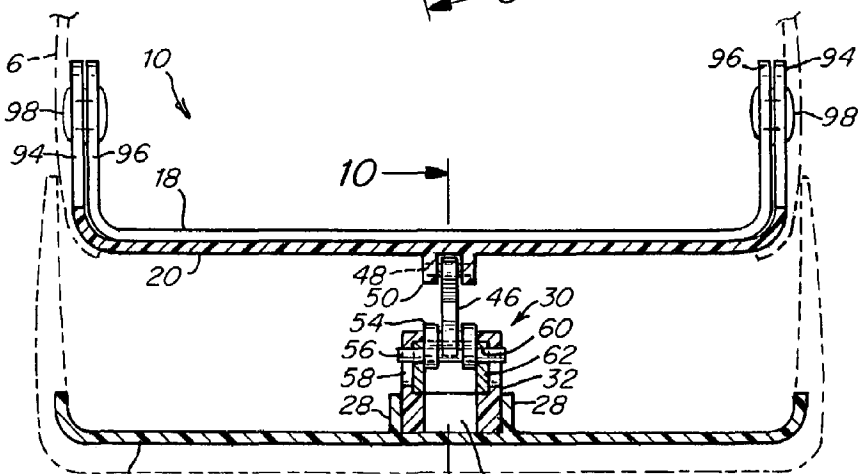
FIG. 3 is a transverse cross-sectional view taken along line 3-3 of FIG. 1.

As indicated previously, the rigid forefoot pressure plate 20 is hinged to the forefoot portion 26 of the housing 22 at pivot point P1. For this purpose there is provided a pair of brackets 88 mounted on the underside of the pressure plate 20 coupled by a pin or pins 92 to a pair of brackets 90 formed in the foremost ends of reinforcing ribs 28 that extend along the length of the forefoot portion 26 of the housing 22. FIG. 1 depicts the elongated shape of the ribs 28 and FIG. 3 depicts the cross-sectional construction of the ribs 28. Alternative means such as a living hinge (not shown) may be used instead of the brackets and pivot pin.

The pressure plate 20 extends rearward at 86 and rests on top of the air bladder 8 and may have a slightly cupped shape, as illustrated in FIG. 1, for strength and comfort. As indicated in FIG. 3, the pressure plate 20 is provided with a pair of brackets 94 formed extending from its sides close to a midway position (see FIG. 1) along its length to provide a pivot point P2 between the two pressure plates 18 and 20. The pressure plate 18 has matching brackets 96 formed at its foremost end that are attached to brackets 94 by pins 98. The pressure plate 18 rests on top of the rearmost portion 86 of plate 20 and may have a flexible membrane 84 attached to its outer periphery and to the top rim of the heel portion 24 of the housing 22 to provide a dust and contaminate shield. As depicted in FIG. 1, the plate 20 preferably has a small step that accommodates the front end of the plate 18 so that there is a smooth surface transition at that location.

Figure 5:
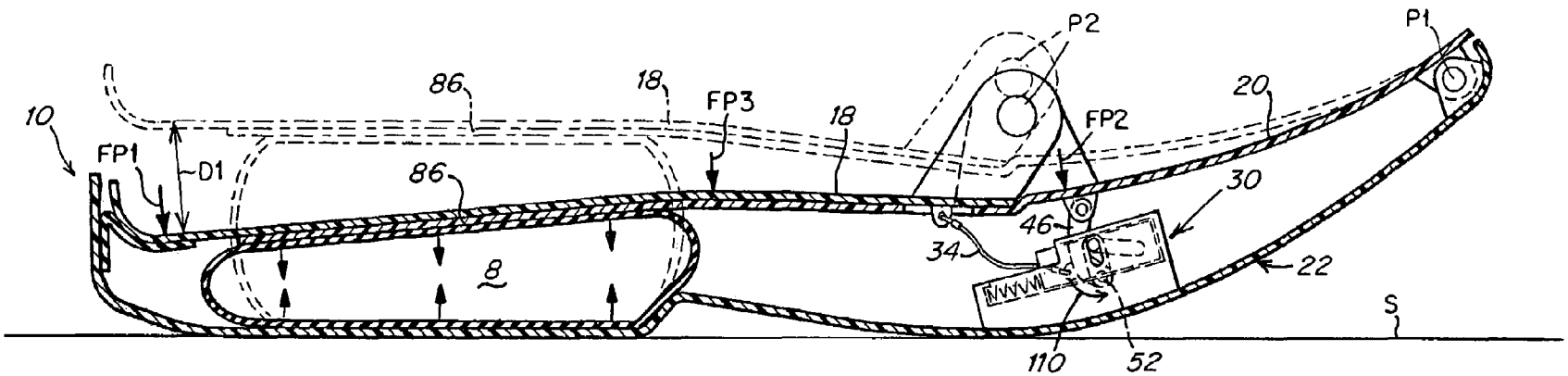
FIG. 5 shows the shoe of FIG. 4 in the position of a minimum amount of energy to be stored such as under the weight of the wearer only.

The pressure plate 18 is free to pivot about pivot point P2 that is depicted in FIG. 1, but the pivoting is limited so that the pressure plate 18 pivots primarily counterclockwise about pivot point P2 due to the contact with the rearmost portion 86 of the pressure plate 20. Any counterclockwise rotational force on the plate 18 acts through the rearmost portion 86 of the plate 20 so as to pivot plate 20 counterclockwise about pivot point P1. This action places a pressure on the air bladder 8, such as is illustrated in FIG. 5. The aforementioned counterclockwise motion is considered as from a "rest" position.

The air bladder 8 underlies the pressure plates 18 and 20 and preferably has a valve or valve stem 80 that is readily accessible through an access hole 82 in the heel portion 24 of the housing in order to adjust the air pressure in the bladder. The valve 80 is adapted to adjust the pressure depending on the weight of the runner. The pressure in the bladder is to be adjusted based on the weight of the wearer. The heavier the user, the higher the initial pressure in the bladder so that there is a direct functional relationship between the weight of the user and the pressure level of the bladder.

Figure 9:
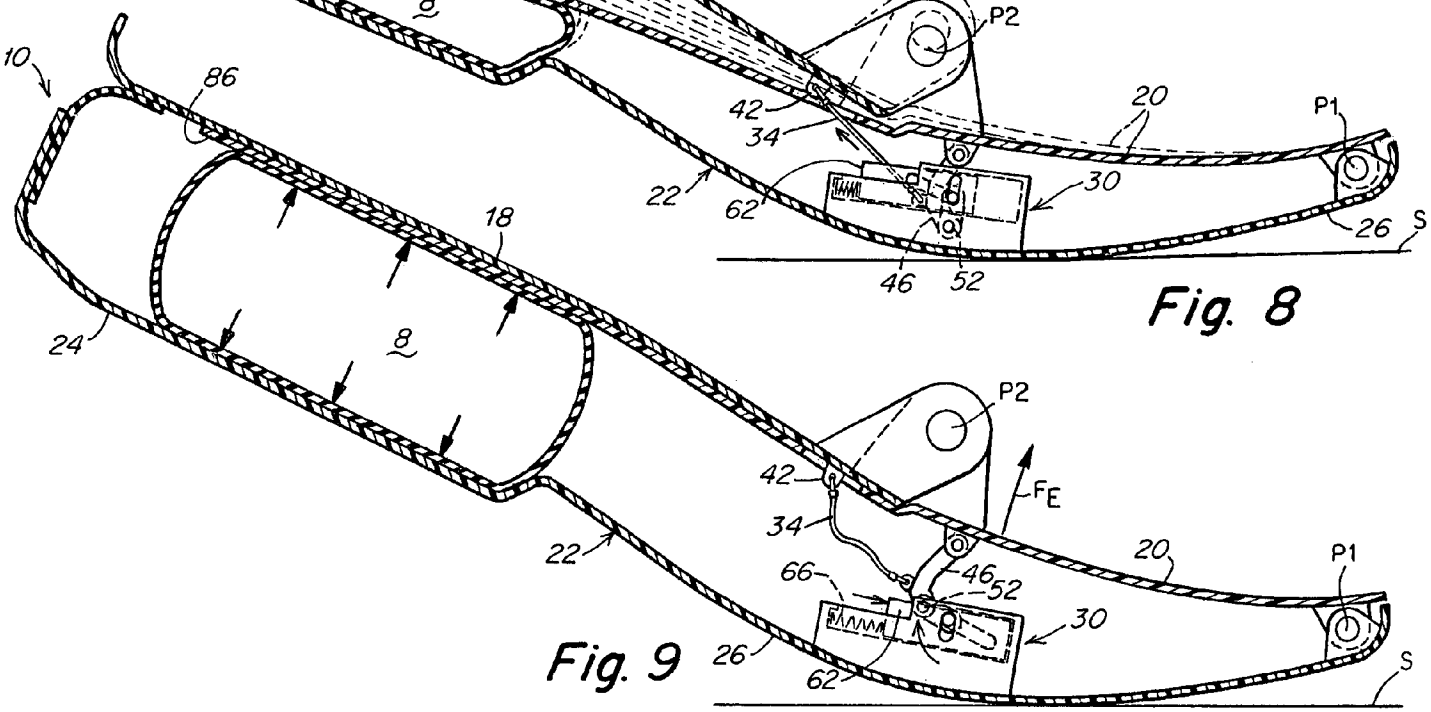
FIG. 9 shows the shoe of FIG. 4 in the position wherein the energy is being returned to the wearer.
Figure 10:
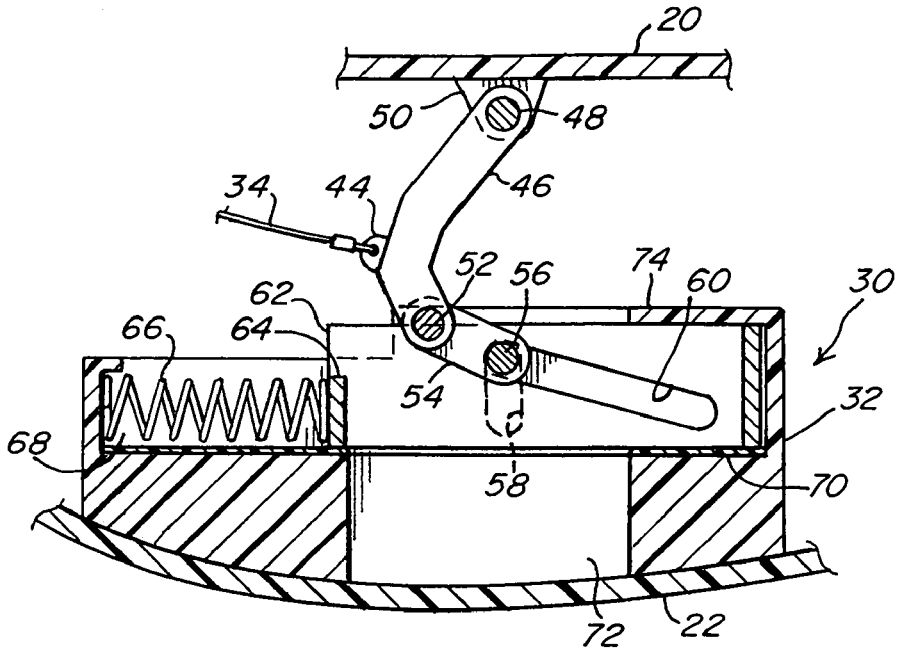
FIG. 10 is an enlarged cross-sectional view of the locking mechanism and as taken along line 10-10 of FIG. 3.
Figure 11:
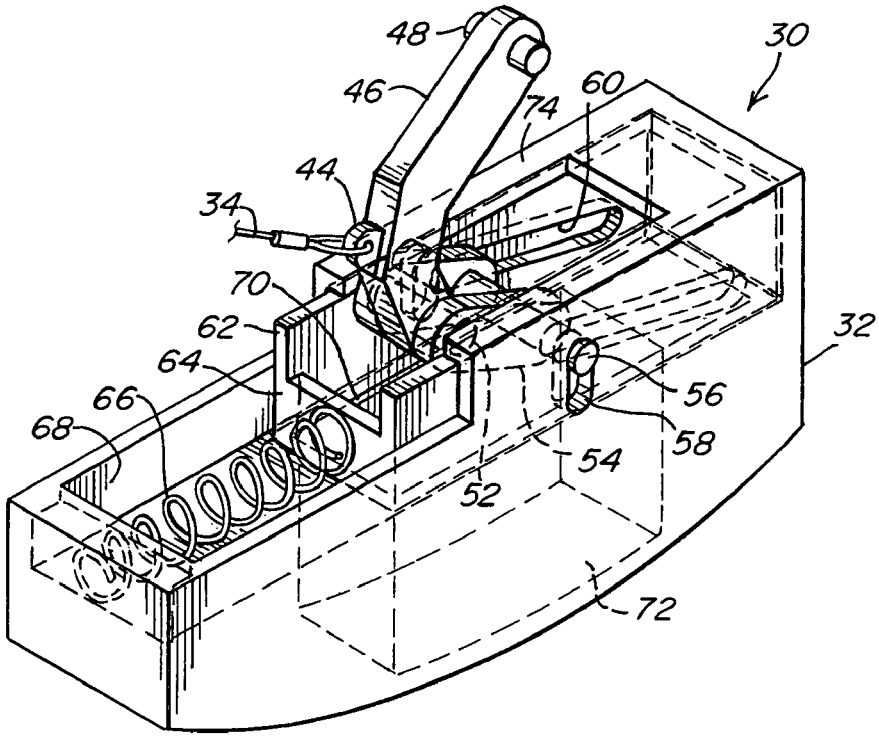
FIG. 11 is a perspective view of the locking mechanism by itself in an "at rest" position.

The locking mechanism 30 is shown in cross-sectional views in FIGS. 1 and 3, as to its location relative to the shoe sole construction. FIGS. 4-9 depict the various positions of the locking mechanism and the corresponding positions of the shoe sole. FIG. 11 is an illustration of a perspective view of the locking mechanism. FIGS. 10 and 12-15 are fragmentary views of the different states of the locking mechanism.

The locking mechanism 30 is fixed between the two ribs 28 of the housing portion 26 (FIG. 3) and is comprised of a housing 32, a carriage 62, spring 66 and links or bars 46, 54. The interaction of the links and carriage provides a ratcheting action to lock the pressure plate 20 in its lowermost position that is attained when the full footfall Pressure FP1-FP3 is applied to the pressure plates 18 and 20 against the pressure in the air bladder 8. The transfer linkage bar 46 is pivotally attached at its uppermost end to pressure plate 20 by brackets 50 affixed to the underside of the pressure plate 20 and pivot pin 48. The lowermost end of bar 46 is pivotally attached to a pair of over center linkage arms 54 by pivot pin 52. The arms 54 are disposed on either side of the transfer linkage bar 46, as shown in FIGS. 3 and 11. The transfer linkage bar 46 is slightly U-shaped or curved to provide some clearance and to provide a stop for the over-center action. The linkage bar 46 also has an anchor flange 44 for a lanyard or cable 34 that is attached at its opposite end to anchor flange 42. FIG. 1 shows the lanyard 34 attached to the underside of pressure plate 18 and passing through the clearance hole 43 in the pressure plate 20.

The lanyard preferably has an adjustable length feature, as illustrated at 36 in FIG. 1. This includes a clamping means 38 that varies the length of the lanyard 34 by lengthening or shortening the loop 40. The adjustable length feature illustrated at 36 may be readily accessible by an access means (not shown) in the side of the housing 22. The lanyard 34 is adapted to initiate the release of the locking mechanism 30 when the footfall pressure is removed and the forward stride of the wearer of the shoe results in the pressure plate 18 pivoting at pivot point P2 a preset distance (see FIG. 15).

The over center linkage arms 54 carry a pin 56 that extends through the arms 54 and through the opposite ramped slots 60 in the carriage 62. The pin also extends further into opposed vertical slots 58 in opposed sidewalls of the housing 32. The carriage 62 is slidably mounted in a recess 68 in the housing 32 and is in the shape of a partially hollow frame with an end wall 64 that abut one end of a light spring 66 that urges the carriage to the right as depicted, for example, in FIG. 10. The carriage easily slides back and forth on a layer of a substantially friction-free material such as the depicted Teflon layer 70. The layer 70 is disposed on either side of the well 72 and thus lines most of the bottom of the recess 68. The carriage 62 is retained in the recess 68 by a U-shaped retaining lip 74 on the top of the housing 32. The lip 74 may be integrally formed with the housing 32 or may be detachably attached to the top of the housing 32. The housing 32 also contains well 72 to accommodate the linkage or bar 46 and arms 54 when the locking mechanism is engaged or activated, such as in the position shown in FIG. 14.

Reference is now made to the operational cross-sectional schematics of FIGS. 4-9. These depict the sequence of action, regardless of where the initial impact occurs. For long distance runners the primary force is imposed at the heel area, illustrated in FIG. 6 by the footfall pressure FP1. For a sprinter the primary force is usually imposed at the toe or ball of the foot area, illustrated in FIG. 6 by the footfall pressure FP2. For an exercise where The wearer lands flat footed this is illustrated by the footfall pressure FP3. Regardless of which pressure is applied, there is a compression of the bladder 8, as illustrated, for example, in FIG. 6.

Figure 4:
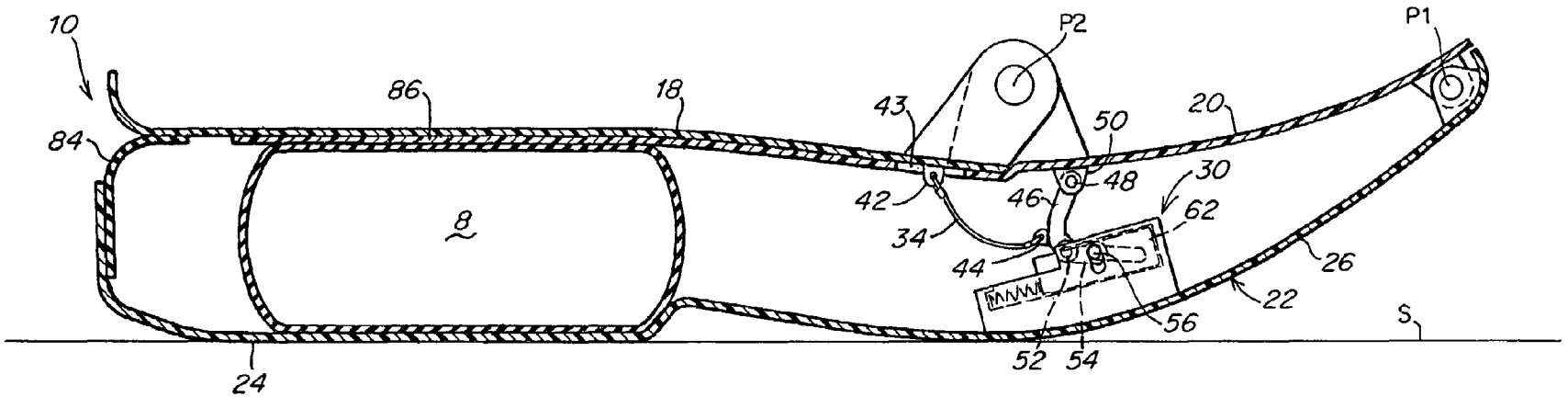
FIG. 4 is a schematic cross-sectional view similar to that depicted in FIG. 1 and showing the shoe in an "at-rest" position without any applied weight.

FIG. 4 shows the shoe at rest with no applied weight, with the air bladder 8 freely supporting the pressure plates 18 and 20. In FIG. 4 the bladder 8 is substantially uncompressed. FIG. 4 also schematically shows the locking mechanism 30 and the pivot points P1 and P2. Refer also to the enlarged cross-sectional view of FIG. 10, as taken along line 10-10 of FIG. 3, and illustrating the initial position of the locking mechanism 30. The locking mechanism 30 is depicted in FIG. 10 at a rest position in which the pin 56 is at the top end of both slots 58 and 60. The spring 66 in the housing 32 biases the carriage 62 to the full right position in FIG. 10. The lanyard 43 is slackened.

Figure 12:
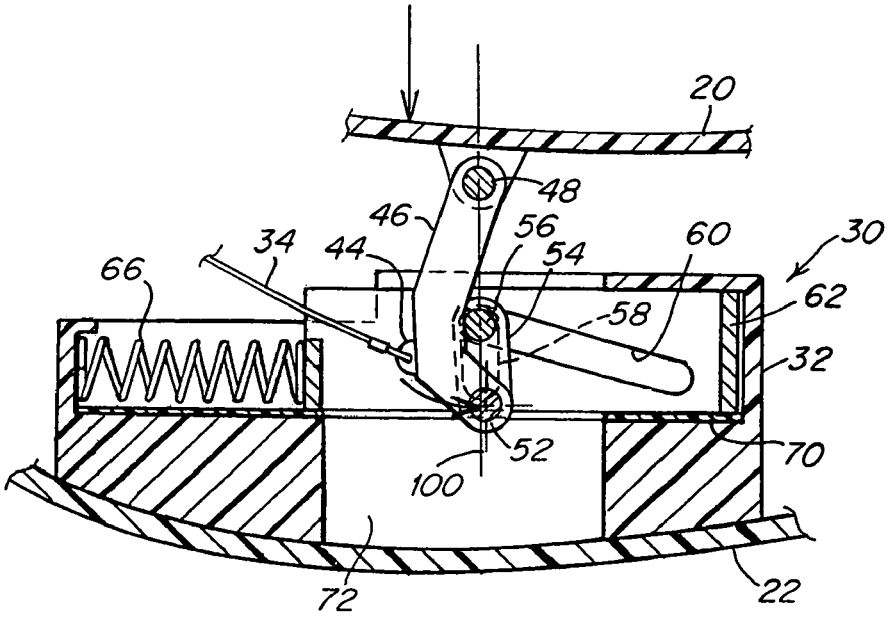
FIG. 12 is a schematic cross-sectional view similar to FIG. 10 but showing the locking mechanism in a position in which a minimum amount of energy has been stored.

FIG. 5 shows the air bladder 8 being compressed by a footfall pressure at FP1 (such as by a walker only standing on the sole). Also represented herein is the footfall pressure FP2 (a sprinter landing on the balls of their feet first) and the footfall pressure FP3 (a flat-footed step). The pressure plates 18 and 20 may be considered as commonly pivoted in a fixed relative relationship therebetween about pivot point P1 a set distance D1. The distance D1 represented in FIG. 5 may be considered as the minimum distance necessary to engage the over-center locking action of the locking member 30. Refer also to the schematic cross-sectional view of FIG. 12 that illustrates the locking mechanism 30 in a position in which at least a minimum amount of energy has been stored. In the position of FIGS. 5 and 12 it is also noted that the plate 20 and thus the pivot point P2 has moved downwardly.

In this position the linkage arms 54 have pivoted counterclockwise about pin 56 in the direction of arrow 110 in FIG. 5, until the linkage bar 46 contacts pin 56. It is noted that the linkage bar 46 is somewhat curved or C-shaped so that there is essentially formed a stop at about a midpoint or turn of the linkage bar 46. The stop of the linkage bar 46 contacts the pin 56 preventing any further pivoting. In this position the pin 52 rests slightly over the vertical (over-center) centerline 100 as seen in FIG. 12. Linkage bar 46 and arms 54 are prevented from any upward motion since pin 56 is at its' uppermost position at the top of slot 58. This effectively locks pressure plate 20 down against the increased air pressure in the bladder and stores the energy for furniture use.

Figure 6:
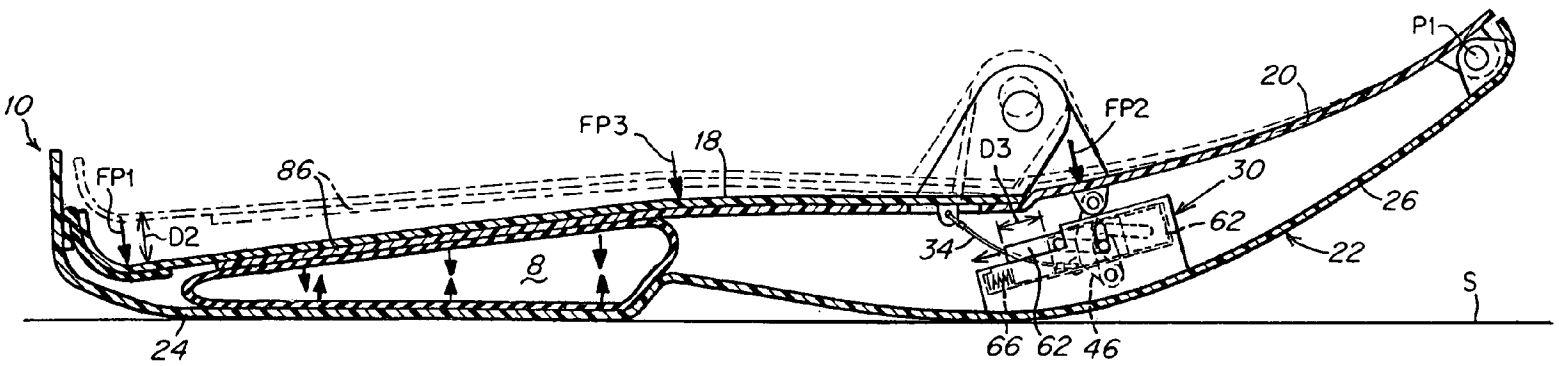
FIG. 6 shows the shoe of FIG. 4 in the position of a maximum amount of energy that is to be stored.
Figure 7:
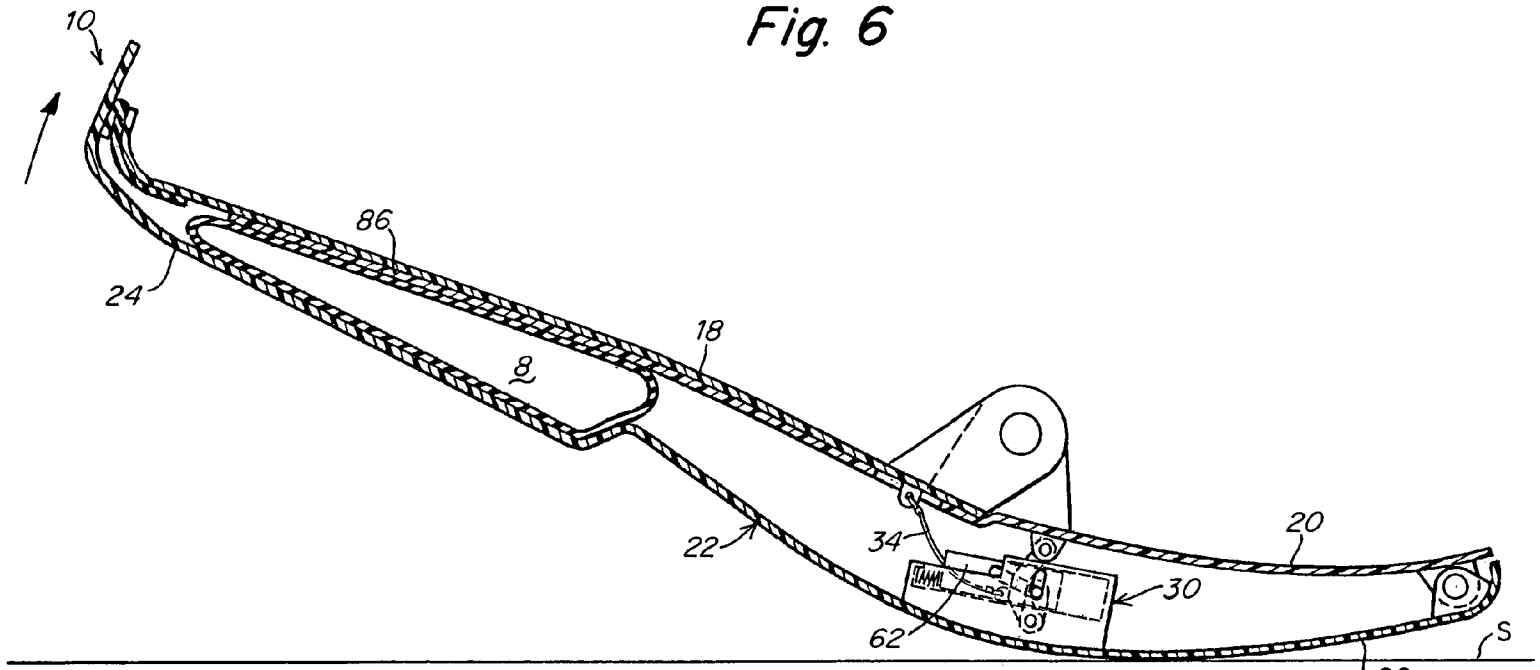
FIG. 7 shows the shoe of FIG. 4 in the position of being rocked forward mid-stride.

Further downward force from a footfall increases the stored energy as depicted in FIGS. 6 and 7. As indicated previously in FIG. 5, a heel strike FP1 on the plate 18 compresses the air bladder 8 and also pivots the plate 20 counterclockwise about pivot point P1 enough to initiate the locking mechanism 30. A sprinter landing on the ball of their foot exerts a force FP2 on plate 20 which compresses the air bladder 8 by means of rearmost portion 86 and also further engages the locking mechanism 30. Plate 18 is free to follow the bottom of the wearer's foot. A flat footfall FP3 exerts force proportionately along plates 18 and 20 to compress the air bladder 8 and engage the locking mechanism 30. In any of the aforementioned three conditions the locking mechanism 30 is engaged.

Figure 13:
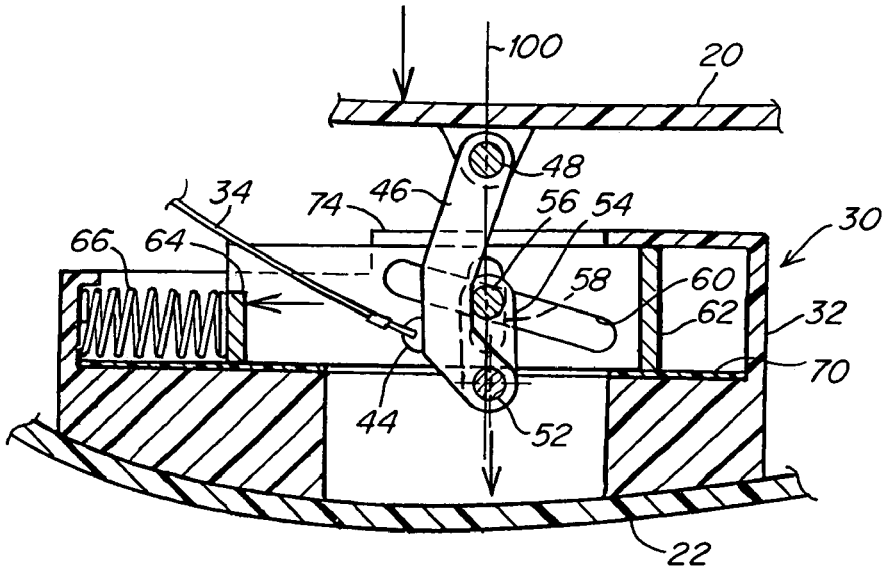
FIG. 13 is a view like that of FIG. 10 but showing the locking mechanism in a position in which a medium amount of energy is stored.
Figure 14:
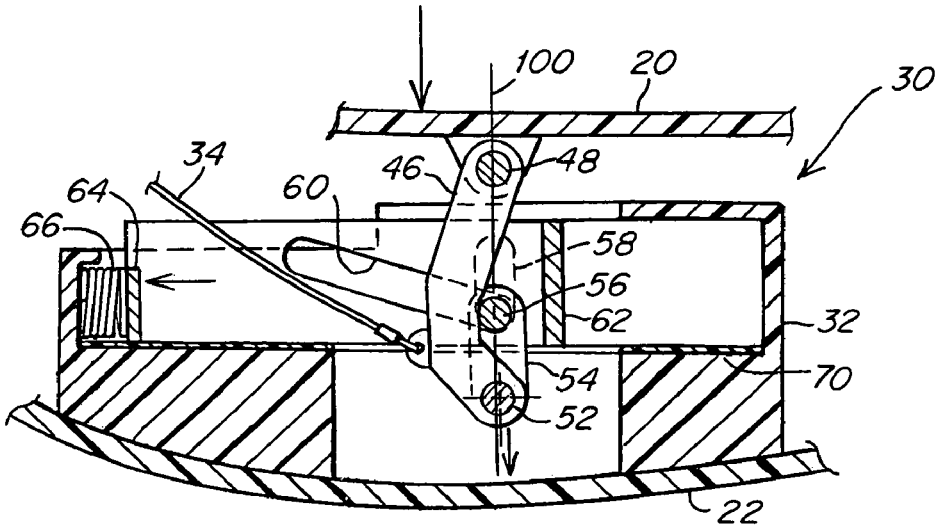
FIG. 14 is a view like that of FIG. 10 but showing the locking mechanism in a position in which a maximum amount of energy is stored.

FIG. 6 shows the shoe of FIG. 4 in the position of a maximum amount of energy that is to be stored. This would be a position corresponding to a hard running condition when the fall of the center of gravity is at a maximum (refer to height "h" in FIG. 16). In FIG. 6 the carriage 62 is to its leftmost position. FIG. 13 is a view like that of FIG. 10 but showing the locking mechanism 30 in a position in which a medium amount of energy is stored. FIG. 14 shows the locking mechanism 30 in a position in which a maximum amount of energy is stored.

In FIG. 13 a midway position is shown corresponding to a medium amount of energy being stored. At the position of FIG. 13 the pin 56 is captured at the intersection of slots 58 and 60 to prevent upward movement of plate 20 until the over center linkages release the plate 20 to travel upward and allow pin 56 to travel freely in slots 58 and 60 with the carriage return being aided by the light spring 66. Thus, in the position of FIG. 13 the spring 66 is partially compressed, the pin 56 has moved part way down the ramped slot 60 and the pin 56 is also about halfway down the vertical slot 58. In comparing the positions of FIGS. 12 and 13 it is noted that the carriage 62 has moved to the left in FIG. 13. It is the movement down the ramped slot 60 that enables sideway motion of the carriage 62. The well 72 provides a space for receiving the locking mechanism 30 as the pin 56 moved down the slot 58.

FIG. 6 shows a heavier footfall force acting on the pressure plates 18 and 20 to further compress the air bladder 8 up to a maximum distance D2. The carriage 62 of the locking mechanism 30 is depicted in FIG. 6 as moving through a distance D3 to accommodate the additional motion of plate 20. As indicated previously, a midway position is depicted in FIG. 13. FIG. 14 shows the locking mechanism 30 in a position in which a maximum amount of energy is stored. The pin 56 is at the bottom of both slots 58 and 60 and the spring 66 has its maximum compression. The carriage 62 is fully to the left against the compression of the spring 66.

Figure 8:
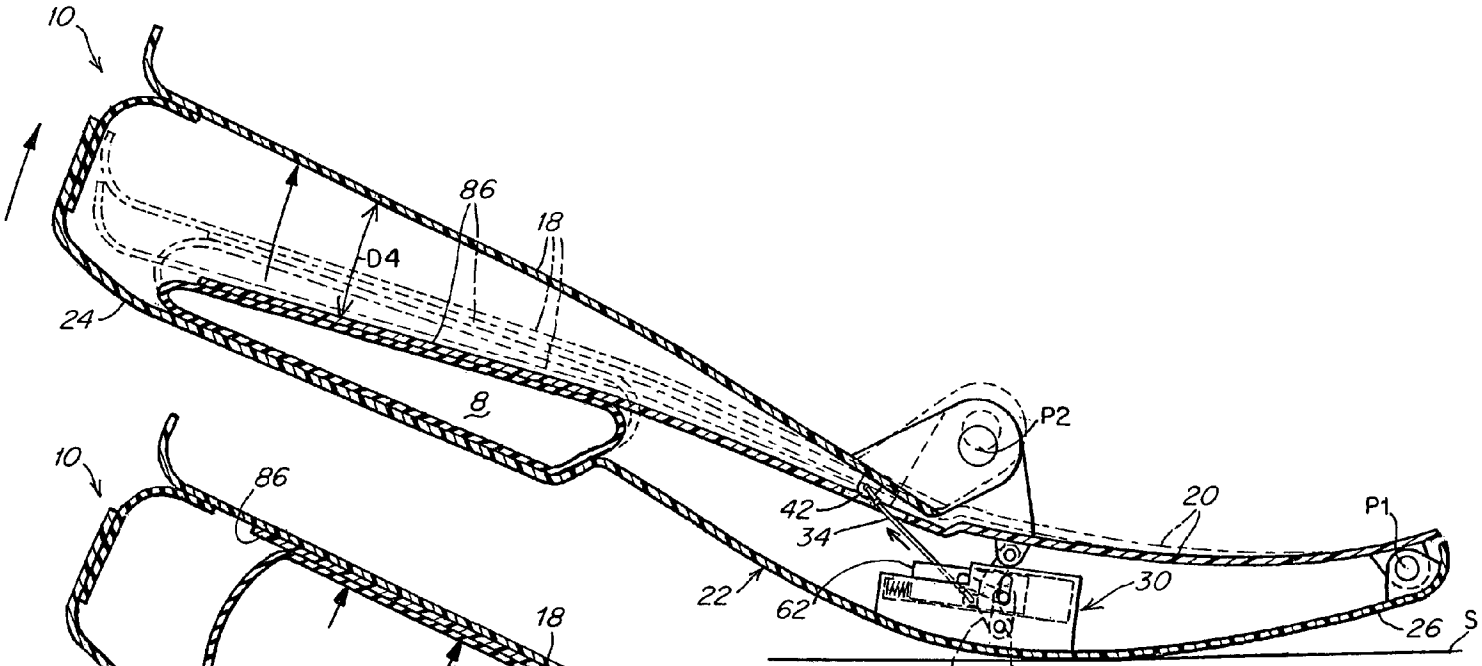
FIG. 8 shows the shoe of FIG. 4 in the position wherein the stored energy is being released.
Figure 15:
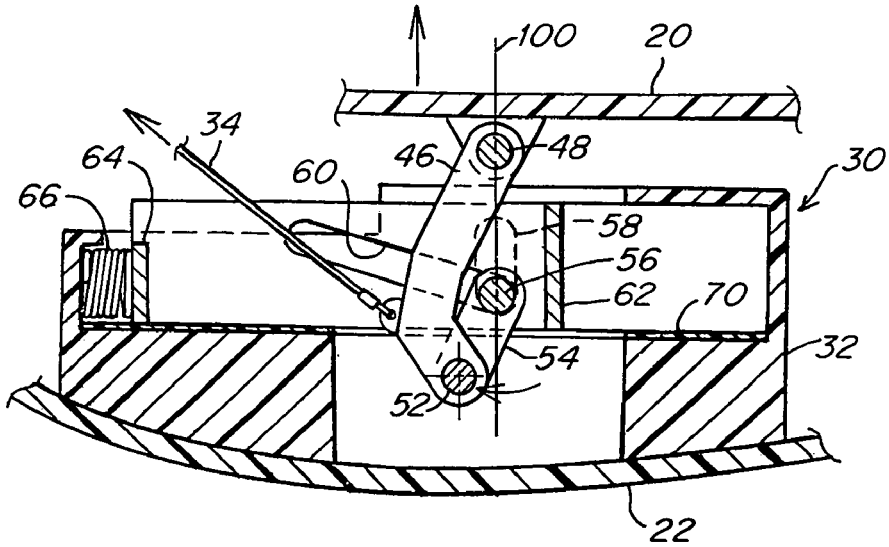
FIG. 15 is a view like that of FIG. 10 but showing the locking mechanism having been released.

FIG. 7 shows the wearer starting to rock forward on the ball of the foot with the locking mechanism 30 still retaining the stored energy. FIG. 8 shows the position at which the locking mechanism is initially triggered to release the stored energy. FIG. 9 depicts the final release of the stored energy. In FIG. 8 the phantom lines show the maximum and minimum positions of plates 18 only and before they are released 20 stays down locked until release of the locking mechanism. The plate 18 lifts with the sole of the wearer's foot a maximum distance of D4 before the lanyard 34 trips the over-center mechanism and releases the stored energy, as indicated by the force arrow FE in FIG. 9. Refer also to the cross-sectional view of FIG. 15 showing the locking mechanism in an energy releasing position. The lanyard 34 has been pulled by the rotation of plate 18 around p in P2 to thus pivot the linkage bar 46 past the centerline 100. This allows the linkages 46, 54 to move clockwise and upward along with plate 20 (Force $F_E$) as seen in FIG. 15. Then pin 56 moves up in slot 58 as slide 62 moves to the right pushed by spring 66.

Further Explanation Of Drawings And Features

In the drawings the members 18, 20 and 22 may be made of epoxy-kevlar (aramid fiber) or graphite, boron, but preferably no fiberglass as that is too heavy. Members 20 and 22 preferably have ribs lengthwise for reinforcement so as to be relatively rigid. The locking mechanism 30 is mounted on inside ribs as shown in FIG. 3 and the pivot points are on outside ribs. Member 8 is the air bladder. This is where the energy is stored and ready to be used instantly when the mechanical lock is released. This component is also very light. It may be constructed of TPU, a thermoplastic urethane, for example. The air bladder 8 preferably has a valve (see valve 80 in FIG. 2) to adjust the pressure depending on the weight of the runner.

Another important consideration in the shoe sole construction is the location of the pivot point P1 which allows a pivoting downwardly at the toe area in order to compress the bladder. This enables the energy to be absorbed regardless of whether the runner falls on the heel, flat-footed or on the ball of the foot. Again refer to the different applied forces shown in FIG. 6 as illustrative forces FP1, FP2 and FP3.

Another feature of the construction of the present invention relates to the particular placement of the pivot point P2. This allows the heel pressure plate 18 to have a limited pivot relative to the forefoot pressure plate 20 and at the right location which corresponds to the joint between the plantar fascia bone and phalange. This occurs while the foot is bending during the propulsion phase. The shoe is very flexible and there is no restraint on the natural motion of the foot. The pressure plate 18 pivoting at pivot point P2 relative to pressure plate 20 pulls the cable 34 which initiates the locking release action. Refer to FIG. 8. The length of cable 34 may be adjusted to change the angle at which the locking mechanism 30 is released by the wearer.

The housing 22 preferably has a relatively large radius(see FIG. 6) between points X and Z under the ball of the foot to allow the foot to rock prior to the pushing phase (approximately 30°). Thus, heel pressure plate 18 does not have to pivot at pivot point P1 until almost the end of the foot bending motion (approximately 10° more) to a total of about 40° before releasing the lock mechanism 30.

The locking mechanism 30 is illustrated herein in the form of a mechanical locking mechanism, however, it can be of numerous alternate constructions. For example, a hydraulic arrangement may be used. A mechanical locking mechanism using linkages has been found to be preferred as it is fast (instant action upon release). The linkages pivot around pins with very little wear and no noise. There is no motion under force. This system requires a very low force from cable 34 in order to unlock the mechanism.

The locking mechanism 30 also preferably includes a carriage or slide. This arrangement enables the mechanism to lock at a variable position, preferably the lowest position plates 18 and 20 have been depressed to. This is to absorb the full amount of energy given by the runner.

The following are further explanations of the action of the locking mechanism of the present invention. With further reference to the drawings in FIGS. 1-15 the housing 22 is on the ground (fixed). The foot rests on the pressure plate 18. Due to the weight of the wearer plate 18 goes down (toward housing 22). Linkage 46 pivots around pin 48. Linkage 54 pivots around pin 56 until they are both vertical, as shown in FIG. 12. The spring 66 keep the linkage slightly over center against a stop. This position is attained under the weight of the runner. That position is locked and may be considered as added to the weight of the wearer. If the wearer runs, there is a potential energy (average height of center of gravity of the runner is approx. 3 inches) and more energy, and consequently force, is applied, after the initial lock just described of the two linkages being vertical. This applies a force on pin 56. The slide or carriage thus moves to the left, such as show in FIG. 13 herein. The groove or slot 60 on the slide has between 10 to 15° slope. The slide or carriage moves to the left because the coefficient of friction on the Teflon is=0.04 which is much lower than the tangent of 10° or 15°. This action compresses the light spring 66 and allows the pin 56 to move downward. When there is no more force applied on pin 56 after the strike of the runner, the bladder pushes plate 20 upward. Pin 56 does now try to go upward, but it instead becomes locked as the slide would have to move back to the right and the coefficient of friction between the slide and housing 32 is high metal to metal (higher than the tangent of angle 10 to 15°). The steel-on-steel coefficient of friction is >0.4. That position, wherever it is, is in a locked position until pressure plate 18 pivots when the cable 34 pulls on pin 52 unlocking the two linkages and thus the entire locking mechanism. At that time pressure plate 20 goes up (force $F_E$) and no more forces are applied on the locking mechanism. The light spring 66 then pushes back the carriage to the right and the lock is then ready for the next strike.

A rubber sheet may be placed under the housing 22 and also on top of pressure plates 18 and 20. Plates 18 and 20 may have some perforations to allow air to flow through the foot to keep it dry and cool. A membrane may be provided to seal between the bladder and parts on either side thereof, so no dirt or moisture enters the shoe. The volume of air flowing would be the volume of air between plate 18 and housing 22 minus the bladder volume. The following are advantages of the construction of the present invention:

1. Good cushioning upon the strike of the runner. The heel collapses approximately 1½ inch—low deceleration and mostly no feed back and vibrations which could have caused injuries to joints, knee, back, etc.

2. Energy mostly absorbed and returned at the right time during the propulsion phase and at the right place under the ball of the foot. This allows the runner to run faster (and/or) longer.

3. The design of the shoe works for all kinds of running including walking.

4. Good for the foot. The shoe is very flexible. It pivots at the joint of the foot and the foot is well supported by pressure plates 18 and 20. The foot works as if there were no shoe on it.

5. Comfort. No heat is generated (except through losses). The bladder air heats under compression but cools during the expansion during the return of the energy. Also holes are preferably provided for some air flow to keep the foot dry.

6. Performance. The air bladder is always ready to return the energy instantly and very little force is needed to release the locking mechanism and rocking action.

7. Provides adjustments for compression (air pressure in bladder) and for when the energy is released (adjustment loop 40).

While this invention has been particularly shown and described with references to preferred embodiments thereof, it will be understood by those skilled in the art that various changes in form and details may be made therein without departing from the scope of the invention encompassed by the appended claims. For example, the embodiments described herein have employed, as the energy storage means, a pneumatic bladder. Alternatively, a mechanical spring arrangement or hydraulic arrangement may also be provided.

What is claimed is:

1. A shoe sole construction adapted to absorb and store impact energy received from the action of a wearer's gait and to deliver said stored energy into the propulsive phase of the gait, said shoe sole construction comprising:

a shoe sole element of resilient rubbery construction and having heel and forefoot portions, said forefoot portion including the toe of the sole;

said shoe sole element including a base housing and at least one pressure plate for receiving the wearer's foot;

at least a first pivot between said base housing and said pressure plate;

energy storage means to receive and store impact energy delivered thereto, said energy storage means disposed at said heel portion of said shoe sole element and positioned to be compressed under the impact energy imposed thereupon by said pressure plate;

and a locking means disposed at the forefoot portion, between said base housing and pressure plate and having respective locked and released positions;

said locking means assuming said locked position in response to a compression of said energy storage means;

said locking means moving to said released position during the propulsive phase of the wearer's gait to return stored energy for release during the propulsive phase.

2. The shoe sole construction of claim 1 wherein said at least one pressure plate includes a rigid heel pressure plate and a rigid forefoot pressure plate, both of which overlie said base housing.

3. The shoe sole construction of claim 2 wherein a portion of said heel pressure plate extends over a rearwardly extending portion of said forefoot pressure plate.

4. The shoe sole construction of claim 3 including a second pivot between said forefoot pressure plate and said heel pressure plate.

5. The shoe sole construction of claim 4 wherein said second pivot comprises a pair of spaced pivots disposed respectively on opposite sides of said shoe sole element.

6. The shoe sole construction of claim 1 including a second pivot between said forefoot portion and said heel portion and disposed at a location corresponding to the joint between the planter fasciae bone and the phalange.

7. The shoe sole construction of claim 1 wherein said base housing includes a heel section and a forefoot section and said energy storage means comprises a pneumatic bladder disposed in a recess between said heel section and pressure plate.

8. The shoe sole construction of claim 7 wherein said bladder has a pressure adjustment means that is set based on the weight of the wearer.

9. The shoe sole construction of claim 1 wherein said first pivot is disposed at the toe of the wearer so that the locking means responds to a strike whether at the heel or forefoot portions or therebetween.

10. The shoe sole construction of claim 1 wherein said locking means comprises a locking mechanism that includes a linkage attached to said pressure plate, a frame and a carriage moveable in the frame and for supporting said linkage.

11. The shoe sole construction of claim 10 wherein said locking means comprises a locking mechanism having a transfer linkage and a release lanyard that is secured to said linkage at one end and to said shoe sole element at an opposite end.

12. The shoe sole construction of claim 11 wherein said lanyard has an adjustment means so that the angle of release of the locking mechanism is adjustable.

13. The shoe sole construction of claim 12 wherein said locking mechanism also includes a frame for receiving a movable carriage, a spring for biasing the position of said carriage and a linkage arm, said linkage arm and transfer linkage being in an over-center position when the locking mechanism is in its locked position.

14. The shoe sole construction of claim 13 wherein said carriage has an angles slot and further including a first pin in slots in said frame and said angled slot and a second pin that interconnects said transfer linkage and linkage arm.

15. The shoe sole construction of claim 1 wherein said locking means operates to temporarily maintain said pressure plate in a downward condition between the end of the strike event and the onset of the propulsive phase of the wearer's gait.

16. A shoe sole construction adapted to absorb and store impact energy and comprising: a shoe sole that includes a heel portion and a forefoot portion; said forefoot portion including the toe of the sole; said shoe sole including a base member and at least one pressure plate for receiving a wearer's foot; a first pivot between said base member and said pressure plate; said first pivot disposed at the toe of the sole; an energy storage member to receive and store impact energy delivered thereto; said energy storage member disposed at said heel portion of said shoe sole and positioned to be compressed under the impact energy imposed thereupon by said pressure plate; and a locking mechanism disposed at the forefoot portion, between said base member and pressure plate; said locking mechanism responsive to a compression of said energy storage means and released during the propulsive phase of the wearer's gait to return stored energy for release during the propulsive phase.

17. The shoe sole construction of claim 16 wherein said at least one pressure plate includes a rigid heel pressure plate and a rigid forefoot pressure plate, both of which overlie said base member.

18. The shoe sole construction of claim 17 including a second pivot between said forefoot pressure plate and said heel pressure plate.

19. The shoe sole construction of claim 16 wherein said base member comprises a base housing includes a heel section and a forefoot section and said energy storage member comprises a pneumatic bladder disposed in a recess between said heel section and pressure plate.

20. The shoe sole construction of claim 16 wherein said locking mechanism includes a linkage attached to said pressure plate, a frame and a carriage moveable in the frame and for supporting said linkage.

21. The shoe sole construction of claim 20 wherein said locking mechanism has a transfer linkage and a release lanyard that is secured to said linkage at one end and to said shoe sole at an opposite end.

22. The shoe sole construction of claim 21 wherein said locking mechanism also includes a frame for receiving the movable carriage, a spring for biasing the position of said carriage and a linkage arm, said linkage arm and transfer linkage being in an over-center position when the locking mechanism is in its locked position.

* * * * *